US005131247A

United States Patent [19]

Hsu

[11] Patent Number: 5,131,247

[45] Date of Patent: Jul. 21, 1992

[54] LOCK ASSEMBLY WITH CURVED KEYWAY

[76] Inventor: Yun-Tung Hsu, No. 65, Lane 189, Sec. 3, Kang-Ning Rd., Nei-Hu Dist., Taipei, Taiwan

[21] Appl. No.: 738,632

[22] Filed: Jul. 31, 1991

Related U.S. Application Data

[63] Continuation-in-part of Ser. No. 520,579, May 8, 1990, Pat. No. 5,086,632.

[51] Int. Cl.[5] ..... E05B 19/08; E05B 27/06

[52] U.S. Cl. ..... 70/358; 70/375; 70/389; 70/399; 70/408; 70/409; 70/419; 70/453

[58] Field of Search ..... 70/358, 375, 389, 395–397, 70/399, 400, 401, 408, 409, 407, 419, 421, 453, DIG. 37, 493

[56] References Cited

U.S. PATENT DOCUMENTS

| | | | |
|---|---|---|---|
| 616,751 | 12/1898 | Vedder et al. | 70/409 |
| 888,478 | 5/1908 | Drew | 70/399 |
| 1,107,376 | 8/1914 | Thiman | 70/396 |
| 1,567,979 | 12/1925 | Northrop | 70/421 |
| 1,886,822 | 11/1932 | Main | 70/375 |
| 1,977,189 | 10/1934 | Larson et al. | 70/DIG. 37 X |
| 3,702,553 | 11/1972 | Nolin | 70/375 |
| 5,086,632 | 2/1992 | Hsu | 70/375 |

FOREIGN PATENT DOCUMENTS

| | | | |
|---|---|---|---|
| 31581 | 3/1927 | France | 70/409 |
| 1273119 | 5/1972 | United Kingdom | 70/395 |

*Primary Examiner*—Lloyd A. Gall
*Attorney, Agent, or Firm*—Townsend and Townsend

[57] ABSTRACT

A lock assembly has a lock body and a flexible key. The lock body includes at least two plug pieces having confronting faces with longitudinal curved grooves. The plug pieces cooperatively form a cylindrical plug. The curved grooves are complementary so as to form a longitudinal curved keyway with a cross-section that is shaped to have an upright first portion and a cross-wise second portion. A first set of tumbler members is provided on the cylindrical plug and extends in the direction of the upright first portion. A second set of tumbler members is provided on the cylindrical plug and extends in the direction of the cross-wise second portion. The flexible key is adapted to be received in the curved keyway and is useful for actuating the tumbler members. The flexible key includes a chain of successively hinged knuckles. Some of the knuckles incorporate a first set of key bit projections which extend in the direction of the upright first portion of the curved keyway so as to actuate the first set of tumbler members. Some of the knuckles incorporate a second set of key bit projections which extend in the direction of the cross-wise second portion of the curved keyway so as to actuate the second set of tumbler members.

15 Claims, 8 Drawing Sheets

LOCK ASSEMBLY WITH CURVED KEYWAY

This is a continuation-in-part application of copending U.S. patent application Ser. No. 07/520,579, filed on May 8, 1990, now U.S. Pat. No. 5,086,632.

BACKGROUND OF THE INVENTION

1. Field of the Invention

The invention relates to a lock assembly with a curved keyway, more particularly to a lock assembly having a lock body with a longitudinal curved keyway and at least two differently oriented sets of tumbler members provided thereon.

2. Description of the Related Art

Co-pending U.S. patent application Ser. No. 07/520,579 discloses a lock assembly having a lock body with a curved keyway and a flexible key. The curved keyway removes tumbler members provided on the lock body from straight access which makes actuation or manipulation of the tumbler members more difficult for a thief. The flexible key has a plurality of knuckles hinged to one another. The knuckles provide a degree of stiffness sufficient to permit insertion of the flexible key into the curved keyway. When inserted, the knuckles actuate the tumbler members and are capable of transmitting the torque applied so as to rotate the lock body and unlock the lock assembly.

Some of the drawbacks of the above-mentioned lock assembly are as follows: 1. Shaking experienced by the flexible key can cause untimely disengagement and eventual accidental misplacement of the key from the lock body. Referring to FIG. 1, the lock body 1 with curved keyway 12 is installed in a car ignition device. The flexible key 11 is inserted into the keyway 12 and friction between the tumbler members and the key 11 hampers unforced disengagement of the flexible key 11 from the lock body 1. However, untimely release of the key 11 from the lock body 1 is still possible because of the weight of the handle portion 13 of the key 11 and because of the vibrations normally experienced by a car when in motion. 2. The curved keyway 12 prevents straight access of the tumbler members to correspondingly increase the difficulty in the actuation or manipulation of the tumbler members for a thief. However, the rectangular cross-section of the keyway 12 permits installation of the tumbler members in only a single direction.

SUMMARY OF THE INVENTION

Therefore, the main objective of the present invention is to provide an improved lock assembly having a lock body with a longitudinal curved keyway that permits incorporation of at least two differently oriented sets of tumbler members.

Another objective of the present invention is to provide an improved lock assembly which incorporates a key engaging means to prevent untimely release of the flexible key from the curved keyway of the lock body.

Accordingly, the preferred embodiment of a lock assembly of the present invention comprises a lock body and a flexible key. The lock body includes at least two plug pieces having confronting faces with longitudinal curved grooves. The plug pieces cooperatively form a cylindrical plug. The curved grooves are complementary so as to form a longitudinal curved keyway with a cross-section that is shaped to have an upright first portion and a cross-wise second portion. A first set of tumbler members is provided on the cylindrical plug and extends in the direction of the upright first portion. A second set of tumbler members is provided on the cylindrical plug and extends in the direction of the cross-wise second portion.

The flexible key is adapted to be received in the curved keyway and is useful for actuating the tumbler members. The flexible key comprises a knuckle assembly including a chain of successively hinged knuckles. Some of the knuckles incorporate a first set of key bit projections which extend in the direction of the upright first portion of the curved keyway so as to actuate the first set of tumbler members. Some of the knuckles incorporate a second set of key bit projections which extend in the direction of the crosswise second portion of the curved keyway so as to actuate the second set of tumbler members.

The flexible key further comprises a handle portion connected to a tail portion of the knuckle assembly, and a hollow key sleeve telescopically connected to the handle portion to cover the knuckle assembly. The lock assembly further comprises a lock shell with an axial bore and an access opening to receive the lock body, and a key engaging ring provided on the access opening and having an inner engaging edge. The hollow key sleeve is provided with a pair of engaging notches to engage the inner engaging edge of the key engaging ring so as to retain the flexible key in a secured position relative to the lock body when the flexible key is operated to unlock the lock assembly.

BRIEF DESCRIPTION OF THE DRAWINGS

Other features and advantages of the present invention will become apparent in the following detailed description of the preferred embodiments with reference to the accompanying drawings, of which.

DETAILED DESCRIPTION OF THE PREFERRED EMBODIMENTS

Figure 1:
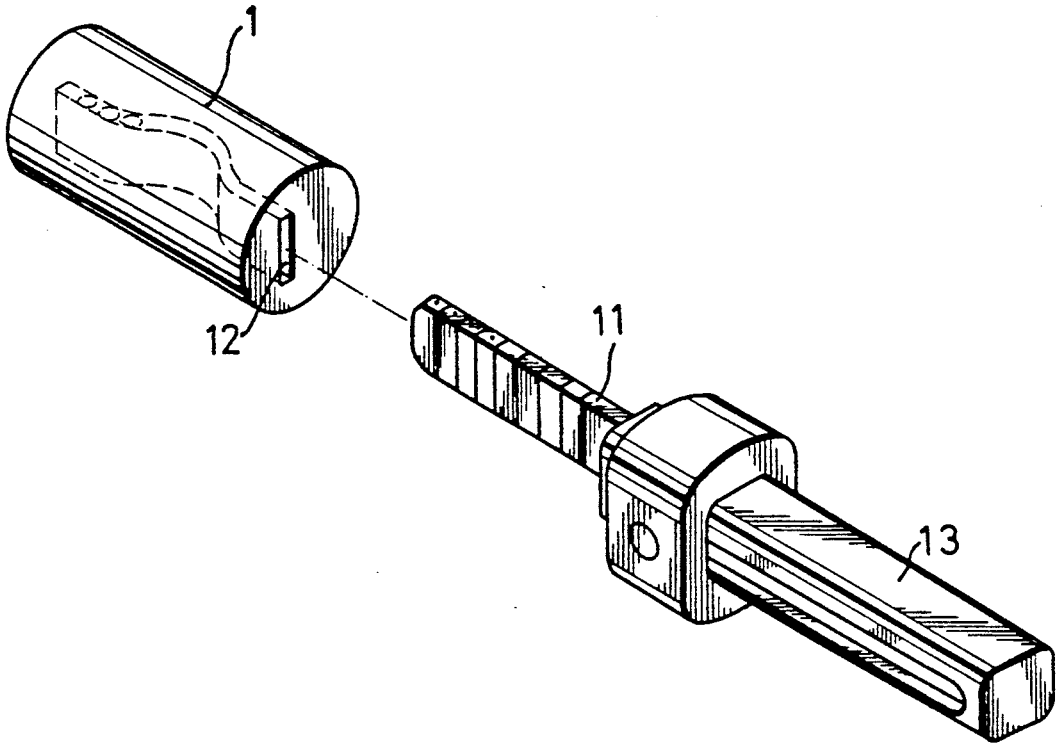
FIG.1 PRIOR ART
FIG. 1 is an illustration of a lock assembly with curved keyway as disclosed in co-pending U.S. patent application Ser. No. 07/520,579.
Figure 2:
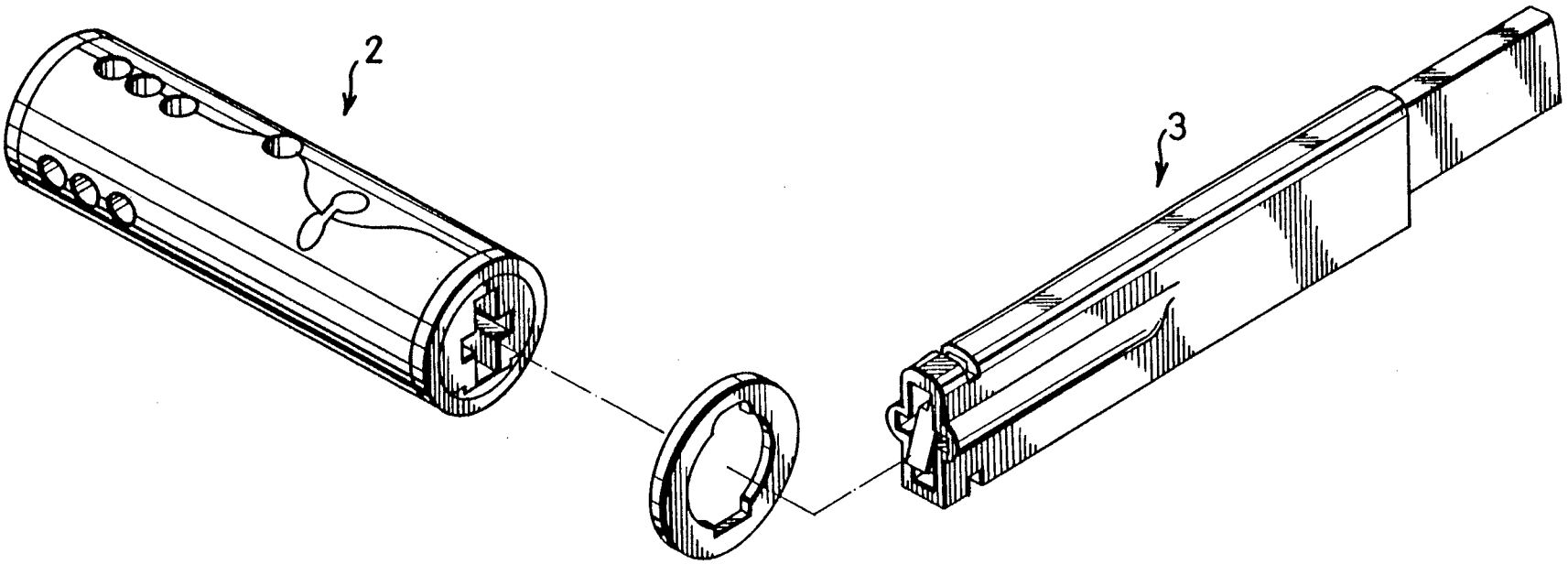
FIG. 2 is an illustration of the lock assembly with curved keyway according to the present invention.

Referring to FIG. 2, the lock assembly of the present invention generally comprises a lock body 2 and a flexible key 3.

Figure 3:
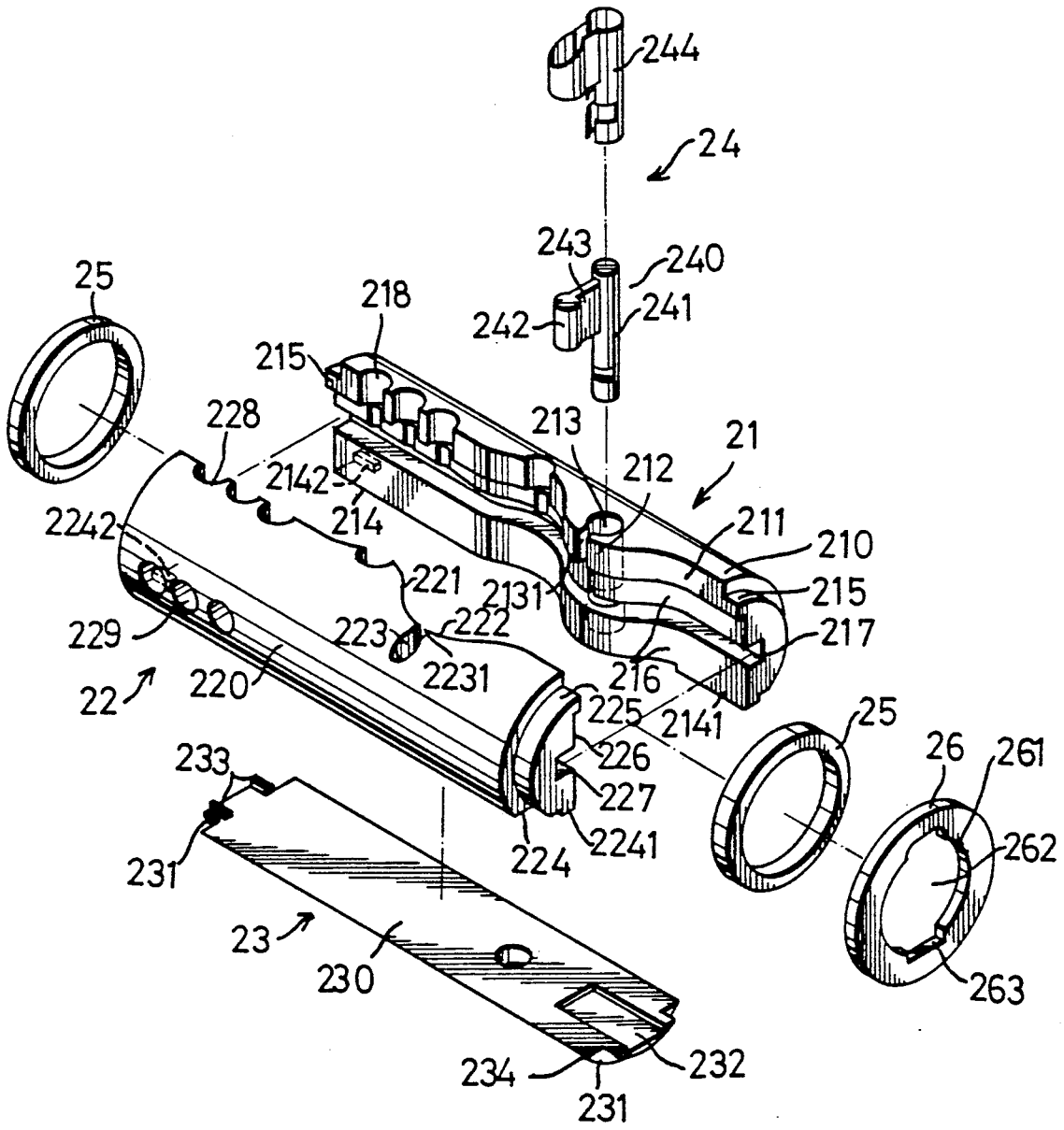
FIG. 3 is an exploded view of the first preferred embodiment of a lock body of the lock assembly with curved keyway according to the present invention.

Referring to FIG. 3, the lock body 2 comprises a first plug piece 21, a second plug piece 22, a base portion 23, a plug connecting means 24, and a pair of metal rings 25.

The first plug piece 21 is substantially similar in shape to an elongated cylinder half and has a curved face 210 and a confronting face 211. The intermediate portion of the confronting face 211 is provided with a hump portion 212. The hump portion 212 is provided with a transverse through hole 213 and a transverse slot 2131 to access the through hole 213. The curved face 210 has a flat bottom 214 with a rectangular projection 2141 on a front end, and a socket 2142 on a rear end. The curved face 210 is further provided with a substantially C-shaped peripheral groove 215 at the front and rear ends thereof. The confronting face 211 is provided with a longitudinal curved groove having an upright first portion 216 and a cross-wise second portion 217. The upright first portion 216 is of a predetermined height and extends from a bottom end of the confronting face 211. The confronting face 211 is further provided with a plurality of tumbler notches 218 extending in the direction of the upright first portion 216 and provided adjacent to the rear end of the first plug piece 21.

The second plug piece 22 complements the shape of the first plug piece 21. The second plug piece 22 is thus substantially similar in shape to an elongated cylinder half and has a curved face 220 and a confronting face 221 to join with the confronting face 211 of the first plug piece 21. The intermediate portion of the confronting face 221 is provided with a depression 222 to receive the hump portion 212 of the first plug piece 21. The curved face 220 is provided with an oval transverse through-hole 223 disposed adjacent to the depression 222. The second plug piece 22 also has a transverse slot 2231 to access the through-hole 223 and to be aligned with the transverse slot 2131 of the first plug piece 21 to communicate with the respective through holes, 213 and 223. The curved face 220 has a flat bottom 224 with a rectangular projection 2241 on a front end, and a socket 2242 on a rear end. The curved face 220 is further provided with a substantially C-shaped peripheral groove 225 at the front and rear ends thereof. The peripheral grooves 225 are to be aligned with the peripheral grooves 215 of the first plug piece 21. The confronting face 221 is provided with a longitudinal curved groove having an elongated upright first portion 226 and a cross-wise second portion 227. The upright first portion 226 is of a predetermined height and extends from a bottom end of the confronting face 221. The confronting face 221 is further provided with a plurality of tumbler notches 228 extending in the direction of the upright first portion 226 and provided adjacent to the rear end of the first plug piece 22. The tumbler notches, 218 and 228, cooperatively confine a first set of tumbler openings to receive a first plurality of tumbler members (not shown). When assembled, the upright first portions, 216 and 226, and the cross-wise second portions, 217 and 227, cooperatively form a longitudinal curved keyway that is cross-shaped in cross-section. The curved portion of the assembled keyway is due to the provision of the hump portion 212 and the depression 222. The curved face 220 is further provided with a second set of tumbler openings 229 disposed adjacent to the rear end of the second plug piece 22 and extending in the direction of the cross-wise second portion 227.

The base portion 23 engages the first and second plug pieces, 21 and 22, at their respective flat bottoms, 214 and 224. The base portion 23 has a flat surface 230 provided with a rectangular groove 231 on a front end to receive the projections, 2141 and 2241, of the first and second plug pieces, 21 and 22. The rear end of the base portion 23 is provided with a pair of plugs 233 to be received in the sockets, 2142 and 2242. The base portion 23 has a curved face 234 so that a cylindrical plug is formed when the base portion 23 is joined to the first and second plug pieces, 21 and 22. The front and rear ends of the curved face 234 are provided with a substantially C-shaped peripheral groove 231 to be aligned with the grooves, 215 and 225, so as to form complete annular paths.

The plug connecting means 24 includes a connector 240 having a first longer stub 241 to be received in the through hole 213 of the first plug piece 21, a second shorter stub 242 to be received in the through-hole 223 of the second plug piece 22, and a plate portion 243 interconnecting the first and second stubs, 241 and 242, and extending into the slots, 2131 and 2231, of the first and second plug pieces, 21 and 22. A metal sleeve member 244 corresponds to the shape of the connector 240 and is sleeved over the same. When assembled, the sleeve member 244 serves to reinforce the joining of the first and second plug pieces, 21 and 22.

The metal rings 25 are provided on the annular paths cooperatively formed by the first and second plug pieces, 21 and 22, and the base portion 23, at the front and rear ends of the same. The metal rings 25 ensure the stable and firm connection of the first and second plug pieces, 21 and 22, and the base portion 23.

Figure 4:
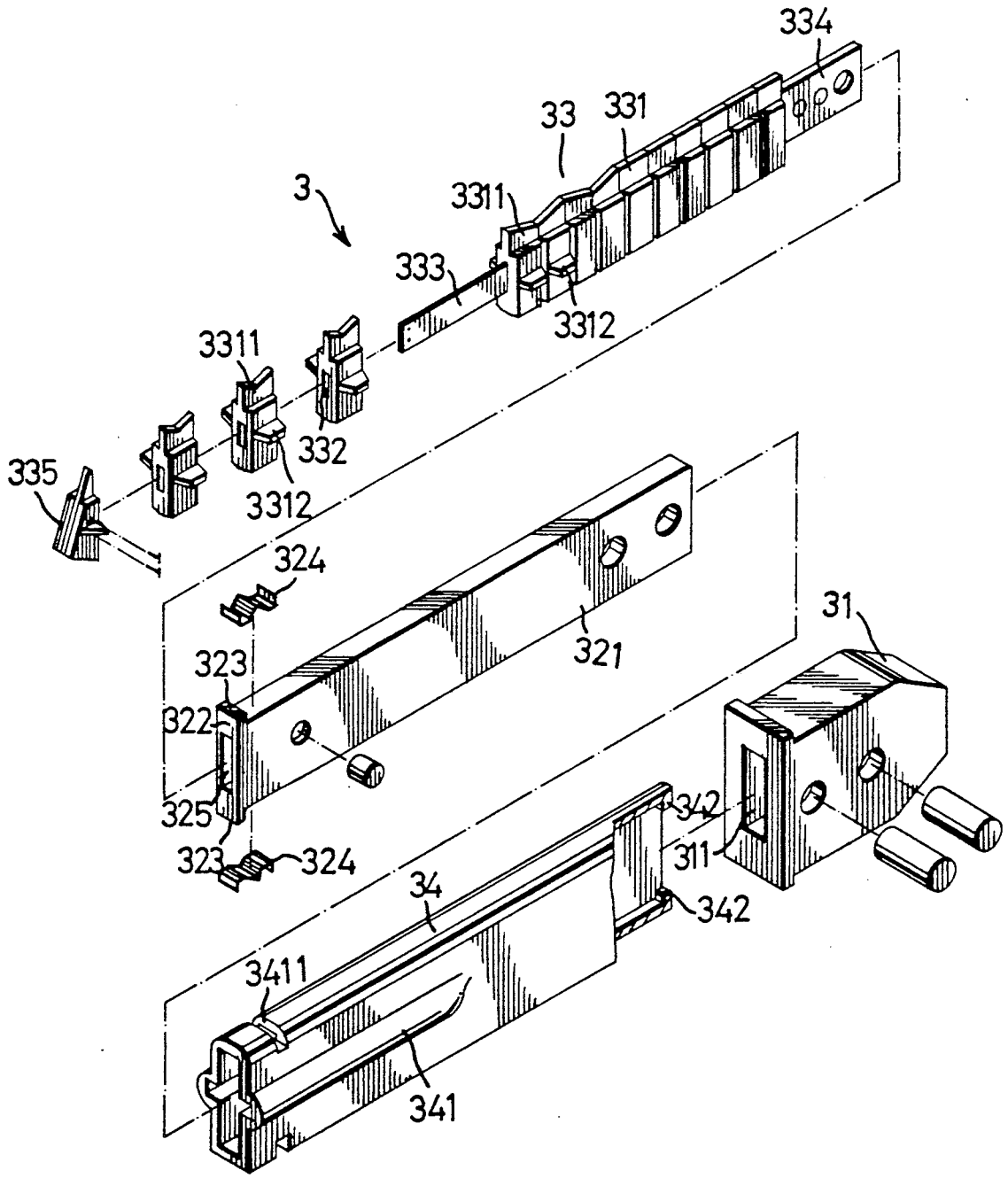
FIG. 4 is an exploded view of the first preferred embodiment of a flexible key of the lock body with curved keyway according to the present invention.
Figure 5:
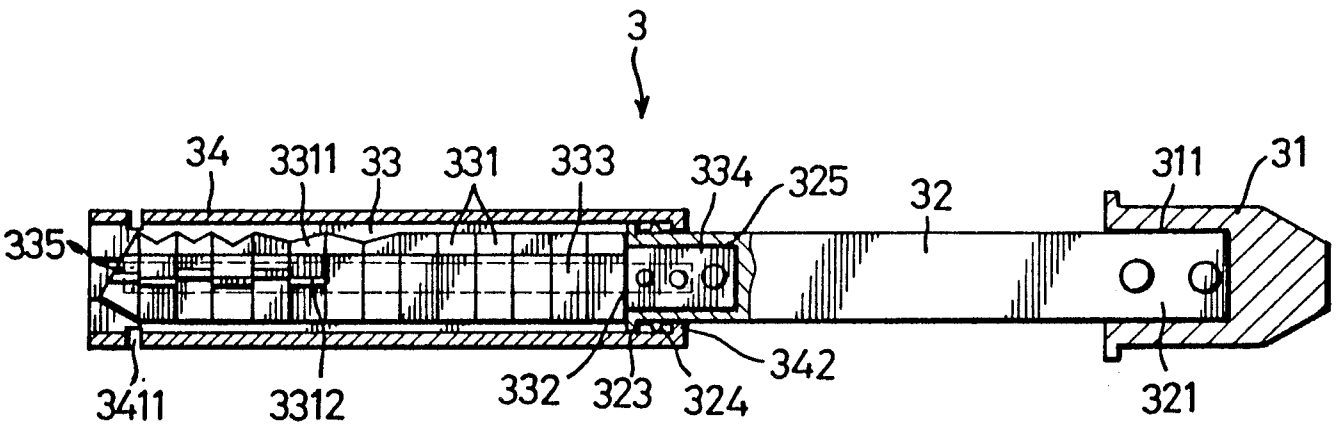
FIG. 5 is a sectional view illustrating assembly of the flexible key shown in FIG. 4.

Referring to FIGS. 4 and 5, the flexible key 3 comprises a handle portion including a handle 31 and an elongated connector 32, a knuckle assembly 33 and a hollow key sleeve 34.

The elongated connector 32 is rectangular in cross-section and has a tail portion 321 secured to the handle 31 at a blind opening 311 provided on a front end of the latter. The head portion 322 of the connector 32 is provided with upper and lower outward flanges 323 and a blind opening 325. A biasing member 324 is provided on the upper and lower portions of the connector 32 inwardly of the flanges 323.

The knuckle assembly 33 includes a plurality of knuckles 331 and a knuckle connecting member 333. Each of the knuckles 331 has a central through hole 332 to receive the knuckle connecting member 333. In this embodiment, the knuckle connecting member 333 is an elongated flexible member, such as a flexible metal plate. The tail portion 334 of the knuckle connecting member 333 is received in and secured to the connector 32 at the blind hole 325, while the head portion of the same is secured to an endmost knuckle 335. The intermediate portion of the knuckle connecting member 33 extends through the knuckles 331 to successively hinge the same. Some of the knuckles 331 are provided with a first set of key bit projections 3311 to actuate tumbler members provided in the first set of tumbler openings formed by the tumbler notches, 218 and 228, of the first and second plug pieces, 21 and 22. (Refer to FIG. 3). Some of the knuckles 331 are further provided with a second set of key bit projections 3312 extending perpendicularly to the first set of key bit projections 3311 and used to actuate tumbler members provided in the second set of tumbler openings 229 of the second plug piece 22. The knuckles 331 may be further provided with a third set of key bit projections extending in a direction opposite to that of the key bit projections 3312 to actuate tumbler members provided in the first plug piece 21. The cross-shaped arrangement of the curved keyway of the lock assembly of the present invention permits the incorporation of a plurality of differently oriented sets of tumbler members to thereby increase the difficulty of picking the lock assembly of the present invention.

The hollow key sleeve 34 is telescopically connected to the connector 32. Referring once more to FIG. 3, 4 and 5, a key engaging ring 26 is to be provided in front of and spaced from the assembled lock body 2. The key engaging ring 26 defines an opening 262 larger than and coaxial with the cross-shaped keyway so as to receive the key sleeve 34. A pair of oppositely disposed notches 263 are provided on the uppermost and lowermost portions of the opening 262. The key sleeve 34 has a front portion with a cross-shaped opening to cover the key bit projections 3312 of the knuckles 331. The front portion of the key sleeve 34 is further provided with upper and lower notches 3411 spaced from the distal end thereof.

When the key sleeve 34 is inserted into the opening 262 and is rotated during an unlocking operation, the notches 3411 receive an inner engaging edge 261 of the key engaging ring 26 to thereby secure the key sleeve 34 onto the key engaging ring 26. The tail portion of the key sleeve 34 is provided with upper and lower inward flanges 342 which slidably abut upon the connector 32 when the flexible key 3 is assembled. The biasing members 324 are provided between the flanges, 323 and 342, so as to position and control the displacement of the connector 32 inside the key sleeve 34. The flanges, 323 and 342, also prevent an untimely disengagement of the key sleeve 34 and the connector 32.

Referring to FIG. 5, the assembly of the flexible key 3 is as follows: The knuckle assembly 33 is secured to the connector 32. The biasing members 324 are provided on the connector 32 and the connector 32 is then inserted into the key sleeve 34. The connector 32 is finally secured to the handle 31. The key sleeve 34 serves as a protective cover for the knuckle assembly 33.

Figure 6:
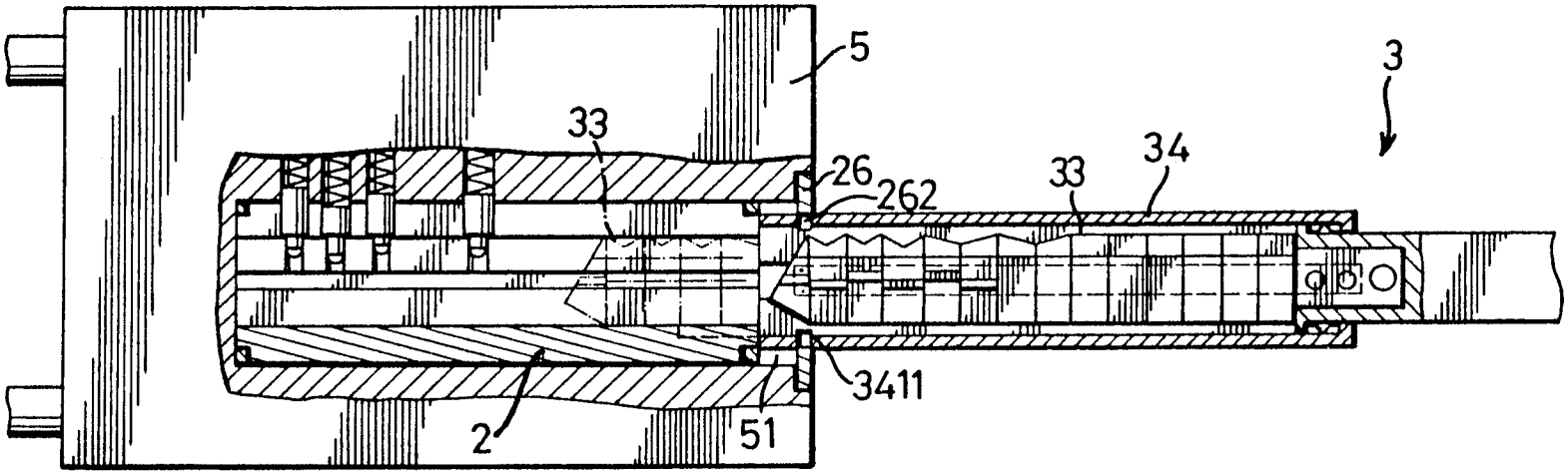
FIG. 6 illustrates the unlocking operation of the lock assembly of the first preferred embodiment.

Referring to FIG. 6, the lock assembly of the present invention further comprises a lock shell 5 with an axial bore 51 and an access opening. The lock body 2 is provided in the axial bore 51, while the key engaging ring 26 is provided in the access opening. When unlocking the lock assembly of the present invention, the key sleeve 34 is inserted into the opening 262 of the key engaging ring 26 until the distal end of the key sleeve 34 abuts upon the front end of the first and second plug pieces, 21 and 22. The handle 31 is then pushed toward the lock body 2 so that the knuckle assembly 33 can extend into the cross-shaped curved keyway thereof. When the knuckle assembly 33 is fully extended into the curved keyway so as to actuate the first and second sets of tumbler members, the key sleeve 34 is then rotated so as to engage the inner engaging edge 261 of the key engaging ring 26 at the notches 3411 thereof and unlock the lock assembly of the present invention. The flexible key 3 is thus retained in a secured position relative to the lock body 2, thereby preventing untimely disengagement. To remove the flexible key 3 from the lock body 2, the flexible key 3 is simply rotated back to the former position to disengage the key sleeve 34 from the key engaging ring 26.

Figure 7:
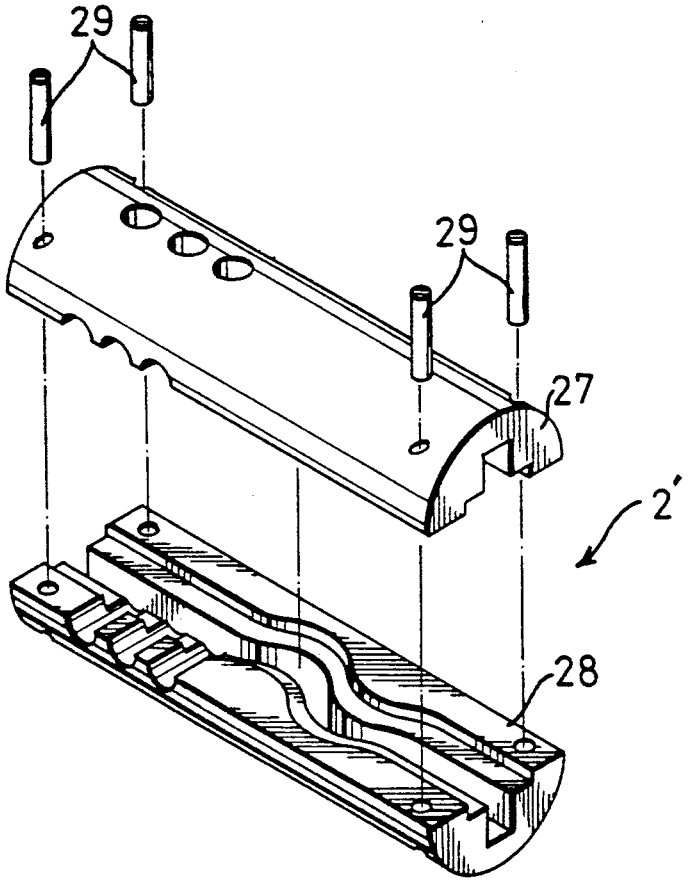
FIG. 7 is a second preferred embodiment of a lock body of the lock assembly with curved keyway of the present invention.

Referring to FIG. 7, a second preferred embodiment of a lock body 2' of the lock assembly of the present invention is shown to comprise upper and lower cylindrical plug halves, 27 and 28. A plurality of fastening pins 29 are provided to join the plug halves, 27 and 28. The assembled construction of the lock body 2' is similar to that of the lock body 2 shown in FIG. 3, and thus will not be detailed further.

Figure 8:
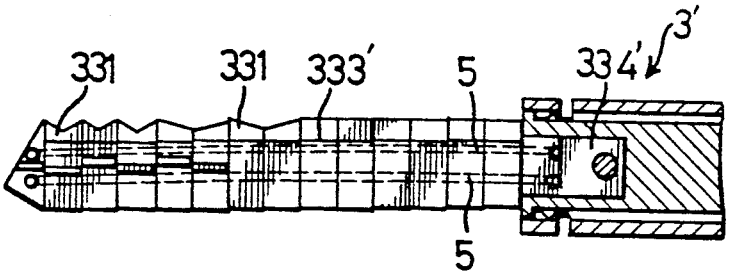
FIG. 8 is a second preferred embodiment of a flexible key of the lock assembly with curved keyway of the present invention.

A second preferred embodiment of a flexible key 3' of the lock assembly of the present invention is shown in FIG. 8 to be substantially similar to the flexible key 3 shown in FIGS. 4 and 5, the main difference lying in the construction of the knuckle connecting member. The knuckle connecting member 333 in FIGS. 4 and 5 is a flexible metal plate. In the flexible key 3' of the second preferred embodiment, the knuckle connecting member 333' has a plate-like tail portion 334' and a pair of flexible metal wires 5, each having a tail end secured to the tail portion 334' and a head end secured to an endmost one of the knuckles 331. The intermediate portion of the metal wires 5 extend through the knuckles 331 to successively hinge the same.

Figure 9:
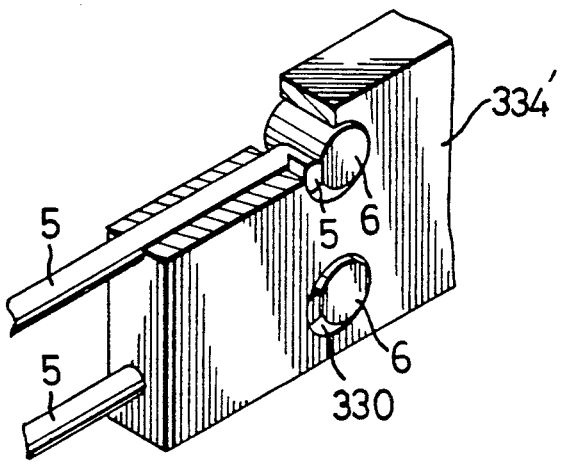
FIG. 9 is an illustration of the knuckle connecting member of the flexible key shown in FIG. 8.

FIG. 9 illustrates how the metal wires 5 are secured to the tail portion 334'. The tail portion 334' is provided with a pair of through holes 330. The metal wires 5 longitudinally extend through the tail portion 334' such that one end of each metal wire 5 hooks with the tail portion 334' at the respective through hole 330. A pin 6 extends into each through hole 330 to secure said one end of the metal wire 5 in the respective through hole 330.

Figure 10:
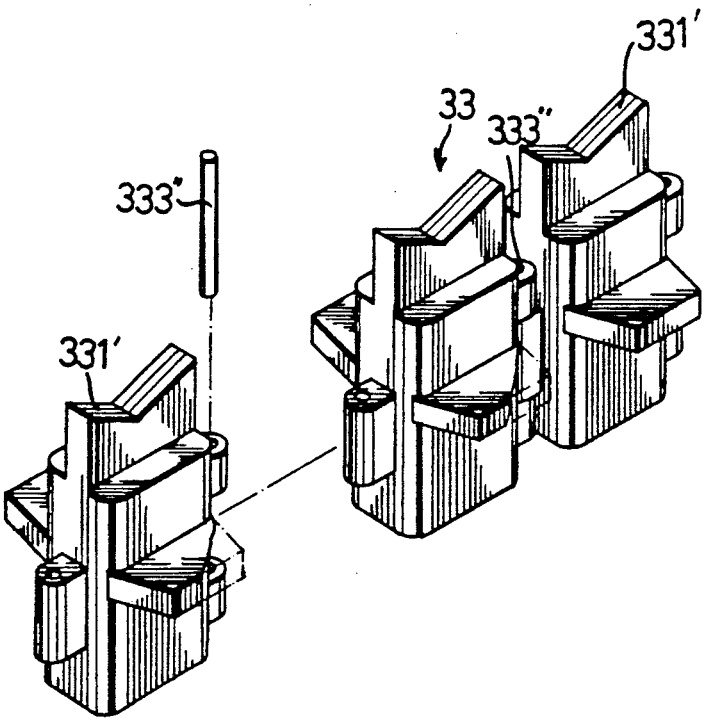
FIG. 10 is an illustration of the knuckle assembly of the third preferred embodiment of a flexible key of the lock assembly with curved keyway according to the present invention.

FIG. 10 is an illustration of the knuckle assembly 33 of the third preferred embodiment of a flexible key of the lock assembly of the present invention. Adjacent knuckles 331' are joined to one another via hinge pins 333''. The knuckles 331' can be turned relative to one another about parallel individual axes.

The characterizing features and the advantages of using the improved lock assembly with curved keyway of the present invention are as follows:

1. The degree of difficulty in picking the lock assembly is increased. The cross-shaped cross-section of the curved keyway of the lock assembly of the present invention is unique and cannot be picked by a rigid object or by a flexible object which is not cross-shaped in cross-section. This enhances the protective features of the lock assembly.

2. The size of the lock body may be diminished without affecting the protective features of the lock assembly. The cross-shaped construction of the curved keyway permits the incorporation of several differently oriented sets of tumbler members. For a given length of lock body, the number of tumbler members which may be incorporated in the present invention is more than that of conventional lock assemblies.

3. The cross-section of the curved keyway should not be limited to a cross-shaped cross-section. Other cross-sections, such as a T-shaped cross-section, may be used. In a curved keyway having a T-shaped cross-section, the curved keyway has an upright first portion and a cross-wise second portion which can be positioned at a wide range of levels relative to the upright first portion.

4. Assembly and construction of the lock assembly is easier and faster. The lock body can be manufactured and assembled in many different configurations (as shown in FIGS. 3 and 7). The flexible key of the lock assembly can be successively hinged together by means of a flexible plate or wire member.

While the present invention has been described in connection with what is considered the most practical and preferred embodiments, it is understood that this invention is not limited to the disclosed embodiments, but is intended to cover various arrangements included within the spirit and scope of the broadest interpretation so as to encompass all such modifications and equivalent arrangements.

I claim:

1. A lock assembly, comprising:

a lock body including at least two plug pieces having confronting faces with longitudinal curved grooves, said plug pieces cooperatively forming a cylindrical plug, said curved grooves being complementary so as to form a longitudinal curved keyway with a cross-section that is shaped to have an upright first portion and a cross-wise second portion, a first set of tumbler members provided on said cylindrical plug and extending in the direction of said upright first portion, and a second set of tumbler members provided on said cylindrical plug and extending in the direction of said cross-wise second portion; and a flexible key adapted to be received in said curved keyway and useful for actuating said first set and said second set of tumbler members.

2. The lock assembly as claimed in claim 1, wherein said flexible key comprises a knuckle assembly including a chain of successively hinged knuckles, some of said knuckles incorporating a first set of key bit projections extending in the direction of said upright first portion of said curved keyway to actuate said first set of tumbler members, some of said knuckles incorporating a second set of key bit projections extending in the direction of said cross-wise second portion of said curved keyway to actuate said second set of tumbler members.

3. The lock assembly as claimed in claim 2, wherein said flexible key further comprises:

a handle portion connected to a tail portion of said knuckle assembly; and a hollow key sleeve telescopically connected to said handle portion to cover said knuckle assembly.

4. The lock assembly as claimed in claim 3, wherein said knuckle assembly further comprises an elongated flexible plate having a tail portion secured to said handle portion, an intermediate portion extending through said knuckles to successively hinge said knuckles, and a head portion secured to an endmost one of said knuckles.

5. The lock assembly as claimed in claim 4, wherein said flexible plate is made of metal.

6. The lock assembly as claimed in claim 3, wherein said knuckle assembly further comprises a knuckle connecting member having a plate-like tail portion attached to said handle portion, and a pair of flexible wires, each having a tail end secured to said plate-like tail portion, an intermediate portion extending through said knuckles to successively hinge said knuckles, and a head end secured to an endmost one of said knuckles.

7. The lock assembly as claimed in claim 3, wherein said knuckle assembly further comprises a plurality of hinge pins each joining adjacent two of said knuckles, said knuckles being turnable relative to one another about individual parallel axes.

8. The lock assembly as claimed in claim 3, further comprising:

a lock shell with an axial bore and an access opening to receive said lock body; and a key engaging ring provided on said access opening and having an inner engaging edge;

said hollow key sleeve being provided with a pair of engaging notches to engage said inner engaging edge of said key engaging ring so as to retain said flexible key in a secured position relative to said lock body when said flexible key is operated to unlock said lock assembly.

9. A flexible key for use with a lock body having a longitudinal curved keyway with a cross-section that is shaped to have an upright first portion and a crosswise second portion, wherein said flexible key comprises:

a knuckle assembly including a chain of successively hinged knuckles, some of said knuckles incorporating a first set of key bit projections extending in the direction of said upright first portion of said curved keyway, some of said knuckles incorporating a second set of key bit projections extending in the direction of said cross-wise second portion of said curved keyway.

10. The flexible key as claimed in claim 9, further comprising:

a handle portion connected to a tail portion of said knuckle assembly; and a hollow key sleeve telescopically connected to said handle portion to cover said knuckle assembly.

11. The flexible key as claimed in claim 10, wherein said knuckle assembly further comprises an elongated flexible plate having a tail portion secured to said handle portion, an intermediate portion extending through said knuckles to successively hinge said knuckles, and a head portion secured to an endmost one of said knuckles.

12. The flexible key as claimed in claim 11, wherein said flexible plate is made of metal.

13. The flexible key as claimed in claim 10, wherein said knuckle assembly further comprises a knuckle connecting member having a plate-like tail portion attached to said handle portion, and a pair of flexible wires, each having a tail end secured to said plate-like tail portion, an intermediate portion extending through said knuckles to successively hinge said knuckles, and a head end secured to an endmost one of said knuckles.

14. The flexible key as claimed in claim 10, wherein said knuckle assembly further comprises a plurality of hinge pins each joining adjacent two of said knuckles, said knuckles being turnable relative to one another about individual parallel axes.

15. A method for manufacturing a lock body with a curved keyway, comprising the steps of:

forming at least two plug pieces having confronting faces with longitudinal curved grooves;

assembling said plug pieces so as to cooperatively form a cylindrical plug and to cause said curved grooves to form a longitudinal curved keyway having a cross-section with an upright first portion and a cross-wise second portion;

providing a first set of tumbler members on said cylindrical plug, said first set of tumbler members extending in the direction of said upright first portion; and providing a second set of tumbler members on said cylindrical plug, said second set of tumbler members extending in the direction of said cross-wise second portion.

* * * * *